US009074578B2

(12) United States Patent
Souply et al.

(10) Patent No.: US 9,074,578 B2
(45) Date of Patent: Jul. 7, 2015

(54) HYDRAULIC MOTOR WITH RADIAL PISTONS AND CONTROL BY CYLINDER

(75) Inventors: Jean-Pierre Souply, Hermanville sur Mer (FR); Guillaume Charrier, La Croix en Touraine (FR); Gilles Lemaire, Margny les Compiegne (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 951 days.

(21) Appl. No.: 13/142,521

(22) PCT Filed: Dec. 30, 2009

(86) PCT No.: PCT/FR2009/052720

§ 371 (c)(1), (2), (4) Date: Oct. 24, 2011

(87) PCT Pub. No.: WO2010/076543

PCT Pub. Date: Jul. 8, 2010

(65) Prior Publication Data

US 2012/0031263 A1 Feb. 9, 2012

(30) Foreign Application Priority Data

Dec. 31, 2008 (FR) ..... 0859172

(51) Int. Cl.
*F01B 13/04* (2006.01)
*F03C 1/30* (2006.01)
(Continued)

(52) U.S. Cl.
CPC ..... *F03C 1/0409* (2013.01); *F03C 1/045* (2013.01); *F03C 1/2438* (2013.01); *F03C 1/247* (2013.01); *F03C 1/26* (2013.01)

(58) Field of Classification Search
CPC ..... F03C 1/0409; F03C 1/045; F03C 1/2438; F03C 1/247; F03C 1/26
USPC ..... 91/476, 478
See application file for complete search history.

(56) References Cited

U.S. PATENT DOCUMENTS 3,961,558 A * 6/1976 Dokukin et al. ..... 91/35
4,004,498 A * 1/1977 Aoki ..... 91/476
(Continued)

FOREIGN PATENT DOCUMENTS

EP 1 319 836 A2 6/2003
FR 2710111 A1 3/1995
(Continued)

OTHER PUBLICATIONS

International Search Report: mailed Oct. 11, 2010; Appln. PCT/FR2009/052720.

*Primary Examiner* — Charles Freay
(74) *Attorney, Agent, or Firm* — Ladas & Parry LLP

(57) ABSTRACT

A hydraulic motor is provided having radial pistons, with a cylinder block, two main ducts, a fluid distributor, one distribution valve per cylinder, and a control system for controlling the distribution valves. The motor includes at least two elementary motors, and can operate in various different states in which, in each elementary motor, each of the cylinders is connected on the rising ramps to a second main duct and on the falling ramps to a second main duct; a first elementary motor being driving in a first state, and inactive or opposing in a second state, the control system operating the remainder of the hydraulic motor in the same way in these two states. A hydraulic circuit including said motor and a method of controlling such a motor are also provided.

18 Claims, 7 Drawing Sheets

(51) Int. Cl.

| | |
|---|---|
| ***F03C 1/40*** | (2006.01) |
| ***F03C 1/24*** | (2006.01) |
| ***F03C 1/247*** | (2006.01) |
| ***F03C 1/26*** | (2006.01) |

(56) References Cited

U.S. PATENT DOCUMENTS

| | | | | |
|---|---|---|---|---|
| 4,945,816 | A * | 8/1990 | Mestieri | 91/473 |
| 6,470,786 | B2 * | 10/2002 | Uski | 91/498 |
| 7,464,549 | B1 * | 12/2008 | Edelson et al. | 60/536 |
| 8,033,210 | B2 * | 10/2011 | Lemaire et al. | 91/491 |
| 2001/0003948 | A1 | 6/2001 | Uski | |
| 2013/0149171 | A1 * | 6/2013 | Caldwell et al. | 417/53 |

FOREIGN PATENT DOCUMENTS

| | | | |
|---|---|---|---|
| GB | 2 167 138 | A | 5/1986 |
| WO | 2008/012587 | A1 | 1/2008 |

* cited by examiner

HYDRAULIC MOTOR WITH RADIAL PISTONS AND CONTROL BY CYLINDER

The invention relates to a hydraulic motor having radial pistons, and a method of controlling said motor. More particularly, the invention relates to a hydraulic motor having radial positions and including:

- a cylinder block, in which each cylinder has a chamber in which a piston is mounted to slide;
- a cam, on which each of the pistons can exert pressure in order to generate torque, the cam having at least two lobes, each lobe having a rising ramp and a falling ramp, the cylinder block being mounted to rotate relative to the cam;
- at least two main ducts, via which the motor can receive or send fluid;
- a fluid distributor for distributing the fluid from said main ducts to the cylinders, which distributor includes, for each cylinder, a distribution valve suitable for connecting the chamber of the cylinder to one or the other of said main ducts, so as to enable fluid to enter into or to exit from said chamber; and
- a control system including an angular position sensor for sensing the angular position of the cam relative to the cylinder block, for controlling the distribution valves.

The main ducts are usually connected via link ducts to respective ones of the delivery and inlet orifices of a pump or to accumulators delivering a pressurized fluid flow rate to the motor.

The distribution valves, provided for each of the cylinders, make it possible to control, at any time, and cylinder-by-cylinder, the distribution of fluid in the cylinders.

Such a hydraulic motor may, for example, serve to drive a vehicle in translation or to drive a tool carried by a vehicle. Generally, the speed that is required for this type of motor is becoming increasingly high, in particular for enabling the vehicle to travel quickly between two sites on which it is used, or for enabling the tool to travel quickly between two working positions. The hydraulic motor must therefore be capable both of generating high torque, so as to perform the functions of the vehicle or of the tool correctly under working conditions, and also of having a high output speed, for the reasons indicated above.

A first solution for enabling these various operating states to be achieved, when a motor of constant cylinder capacity is used, consists in using a pump suitable for delivering to the motor either a very low flow rate or a very high flow rate, as a function of the operating state required. That solution suffers from the drawback of requiring a high-capacity pump to be used.

Another solution consists in using a motor having a plurality of operating cylinder capacities. Preferably, in that solution, the motor that is used has a wide range of cylinder capacities or, in equivalent manner, a very high maximum-to-minimum ratio, the maximum-to-minimum ratio being the ratio between the largest cylinder capacity and the smallest cylinder capacity of the motor. Such a motor can then be used with a smallest cylinder capacity that is much smaller than the largest cubic capacity. The smallest cylinder capacity is used for high-speed and low-torque applications, e.g. for enabling the vehicle to travel on the road; the largest cylinder capacity is used for the "work" mode, by guaranteeing high torque at low speed of rotation.

In a motor having at least two operating cylinder capacities that are quite different from each other, in order to enable pleasant, jolt-free, operation, and in order to limit the variations in flow rate required of the pump, it is desirable for the motor to have intermediate cylinder capacities so as to make it possible to go smoothly between its various cylinder capacities.

Patent GB 2 167 138 describes a version of such a hydraulic motor. The motor it describes is a motor of the type specified in the introduction, in which each cylinder has a distribution valve, the distribution valves being controlled by an electronic control unit. In that motor, the cylinder capacity is modulated continuously, by limiting to a given angular sector the range in which the cylinders of the motor are activated and deliver torque (whether that torque be drive torque or braking torque). Due to that mode of control, the reversal of the pressure applied in the cylinders takes place while said cylinders are moving; and so that change of pressure causes pressure peaks or depressurizations in the cylinders, generating variations in torque and in speed on the outlet of the motor, vibration, premature wear on the cam, on the cylinders, and on the pistons, and lack of stability.

Finally, the forces applied by the various pistons on the cam do not cancel out mutually; for that reason, substantial forces are exerted in the structure of the motor, thereby reducing the lifespan of said motor.

A first object of the invention is to propose a motor that is of the type presented in the introduction, that has a plurality of operating cylinder capacities, but that does not suffer from the above-mentioned drawbacks of instability, of vibration, and of significance of the forces exerted on the structure of the motor while it is operating.

This object is achieved by means of the fact that:

a) the motor includes at least two elementary motors;

b) the control system is suitable for operating the distribution valves in such a manner that the motor has a plurality of states (or operating states), in which states, in each elementary motor, each of the cylinders is put into communication on the rising ramps with a first main duct and on the falling ramps with a second main duct that is distinct or not distinct from the first main duct, any changes to these communications taking place when the cylinder passes substantially facing a top or bottom dead center, on the basis of the information delivered by the angular position sensor; and c) a first elementary motor is driving when the motor is in a first one of said states, and is inactive or opposing when said motor is in a second one of said states, the control system operating the remainder of the hydraulic motor in the same way in said first and second states.

In the meaning of the invention, an elementary motor of a hydraulic motor is a portion of the motor that is capable, when it is fed on its own, of supplying (non-zero) drive torque to the outlet member of the motor, and of doing so regardless of the angular position of said outlet member relative to the stator structure of the motor. Preferably, the torque delivered by the elementary motor is substantially independent of the angular position of the outlet member of the motor relative to the stator structure of the motor. Therefore, an elementary motor, when it is fed on its own, is capable of delivering work similar to the work delivered by the full motor, but with speed of rotation and torque that are different from those of the full motor, the cylinder capacity of the elementary motor being different from the cylinder capacity of the full motor.

In practice an elementary motor is generally characterized as follows:

With the lobes being distributed in one or more groups of lobes and the cylinders being distributed in one or more groups of cylinders, each elementary motor is defined by a group of cylinders and by a group of lobes, and includes those of the cylinders of the group of cylinders that act on the lobes of the group of lobes, the elementary motor being, due to the arrangement of the group of cylinders and of the group of lobes that define it, suitable for delivering torque regardless of the angular position of the cam relative to the cylinder block.

The term "rising ramp" designates herein the portion of a lobe of the cam along which a piston that acts on said portion comes out of its cylinder, and the term "falling ramp" designates herein the portion of a lobe of the cam along which a piston that acts on said portion retracts into its cylinder.

Thus, in a motor of the invention, instead of varying the cylinder capacity of the motor by limiting the activation of the cylinders by an angular criterion, the cylinder capacity is varied by activating in drive mode or in opposing mode, or by deactivating, one or more elementary motors of the hydraulic motor. Since the change in pressure in the cylinders is made when their pistons pass substantially facing a top or bottom dead center of the cam, cylinder wear and vibration is reduced.

Operation and advantages of a motor subjected to such control can be understood more clearly by analyzing the role of the elementary motors. For example, it is assumed herein that the motor of the invention is fed by a pump. Thus, the main ducts of the motor are connected to respective ones of the delivery and inlet orifices of the pump that delivers the fluid to the motor. These orifices are normally at the high pressure (HP) and at the low pressure (LP) of said pump.

The motor further includes an outlet shaft, to which each of the elementary motors applies torque.

When the motor is in the states as specified above, at least the first elementary motor of the motor of the invention finds itself in one of the three following operating modes:

"drive" mode: depending on whether it is facing a rising ramp or a falling ramp of a lobe of the elementary motor, each cylinder of the elementary motor is connected via a main duct respectively either to the pump high pressure or to the pump low pressure; the elementary motor delivers drive output torque in a desired drive direction on the outlet shaft of the motor;

"opposing" mode: depending on whether it is facing a rising ramp or a falling ramp of a lobe of the elementary motor, each cylinder of the elementary motor is connected via a main duct respectively either to the pump low pressure or to the pump high pressure; the elementary motor delivers output torque applied in the direction opposite to the desired drive direction on the outlet shaft of the motor; and "inactive" mode: each cylinder of the elementary motor facing the rising ramps and the falling ramps of the lobes of elementary motor remains connected, via the main ducts, either to the high pressure or to the pump low pressure; the elementary motor thus delivers almost zero output torque on the outlet shaft of the motor.

Naturally, in a motor of the invention, the control system is suitable for operating the distribution valves in such a manner as to run at least one elementary motor, as a function of a setpoint specifying an operating mode chosen from among drive, opposing, or inactive. The control system thus uses a setpoint that is valid throughout a duration of operation of the motor, corresponding to a certain number of revolutions of the motors, and converts said setpoint into elementary commands at relatively high frequency, transmitted to the distribution valves so as to put the chambers of the cylinders of the elementary motors into communication with the appropriate main ducts for appropriate lengths of time. Thus, for example, if the first elementary motor includes a group of cylinders mounted to rotate relative to a cam in a motor having radial pistons, the control system causes the distribution valves to be switched as a function of the positions of the cylinders relative to the cam so that the elementary motor effectively delivers drive torque, if the chosen operating mode is drive mode, braking torque for the opposing operating mode, and no torque if the chosen operating mode is inactive mode.

For this control, the control system generally has a table giving, as a function of the angular position of the cylinder block relative to the cam, over 360°, the state desired for the distribution valves of the elementary motor.

In general, the control system is electronic, such control systems benefiting from high operating frequency and thus guaranteeing precise control of the switching of the distribution valves, with, in particular, it being possible to take account of a phase advance, etc.

By means of the possibility of activating or of not activating the first elementary motor, the hydraulic motor has at least two distinct active operating cylinder capacities that are stable due to above-mentioned condition b). The cylinder capacities are obtained on the basis of the combined cylinder capacity of the elementary motors other than the first elementary motor, by adding the cylinder capacity of the first elementary motor, or by subtracting it, or without adding or subtracting anything if the first elementary motor is inactivated.

According to the embodiment of the motor of the invention, the control system is suitable for operating the distribution valves in such a manner as to cause one of, two of, . . . up to all of the elementary motors to operate in "drive", "opposing", or "inactive" mode, independently of the command applied to the other elementary motors. Advantageously, due to the combinatory possibilities procured by this operating mode of the motor, and as a function of the number of elementary motors that the control system can operate in said three operating modes, the motor has a wide range of cylinder capacities.

At any time, the total cylinder capacity of the motor is equal to the sum of the cylinder capacities of the "drive" elementary motors, minus the sum of the cylinder capacities of the "opposing" elementary motors. Advantageously, a motor having n elementary motors can thus have up to $(3^n-1)/2)$ different active operating cylinder capacities (depending on the individual cylinder capacities of each elementary motor), thereby imparting high operating flexibility to it.

Finally, it should be noted, within the ambit of the invention, the motor can be used, at least some of the time, as braking means, which amounts to the motor being used as a pump.

Preferably, the control system only controls the motor in states such as those specified above. In such states, for each cylinder of the motor, the change of position of the distribution valve that is associated with it takes place when the cylinder passes substantially facing a top or bottom dead center of the cam (i.e. respectively the point at which the piston is deployed to the greatest extent, and the point at which the piston is deployed to the smallest extent). At these points, the speed of the piston is substantially zero; as a result, the change of pressure in the cylinder takes place smoothly, without flow being drawn into it and without excessive mechanical stresses; thus vibration and premature wear of the cylinders and of the pistons are avoided.

Naturally, controlling the distribution valves as specified by point c) can present a phase advance or retard that can be applied in the command, such that the command for changing position of a valve can be temporarily offset slightly relative to the roller passing in contact with the top dead center or bottom dead center of the cam at which dead center the change of position of the valve is scheduled, in order to mitigate the response time between the valve change command and the full change of the valve.

Finally since each elementary motor is suitable for delivering torque regardless of the angular position of the cam relative to the cylinder block, and regardless of the number of elementary motors that are active, i.e. that are applying torque to the outlet members of the motor, the forces transmitted by the various elementary motors are continuous instead of being concentrated into a few time intervals every revolution. Thus, during operation, the forces transmitted to the frame of the motor by the various elementary motors are continuous, thereby contributing to the stability of the motor during operation.

The control system can take account of various information in order to establish the commands: firstly, commands transmitted by the driver of a vehicle on which the motor is mounted; and secondly information delivered to the control system by various sensors such as flow-rate sensors, pressure sensors, etc.

In a motor of the invention, the control system is designed to run the motor as a function of its configuration, defined by the distribution into various different elementary motors. Taking account of this configuration, the control system runs the motor (i.e. the elementary motors thereof) in various operating states.

In particular, the following two particular configurations of a hydraulic motor may be managed by the control system:

In a first embodiment, when the motor is in said states, a single group of lobes is defined, so that each elementary motor includes all of the lobes of the cam. In this situation, the elementary motors can be distinguished from one another by the cylinders that they group together: such elementary motors are referred to as "by-cylinder" elementary motors.

In a second embodiment, when said motor is in said states, a single group of cylinders is defined, so that each elementary motor includes all of the cylinders. In this situation, the elementary motors can be distinguished from one another by the lobes that they group together: such elementary motors are referred to as "by-lobe" elementary motors.

These two embodiments of the motor of the invention make it possible to simplify the control of the elementary motors and thus to simplify the control system.

In an embodiment, the motor has an internal cam. Advantageously, the arrangement of the cylinders outside the cam makes it possible to form a space that is sufficient for the distribution valves. However, the motor may also be an external-cam motor.

In an embodiment, the cam is a rotary cam, and the cylinder block is a stator cylinder block. In view of the relative complexity of the cylinders and of the distribution valves that they include, this arrangement of the cam and of the cylinder block increases the reliability of the motor.

In an embodiment, the first elementary motor has a cylinder capacity that is different from the cylinder capacity of another elementary motor, but that is preferably close thereto. This arrangement makes it possible to increase the number of cylinder capacities relative to the situation in which the cylinder capacity of the first motor is equal to the cylinder capacity of each of the other elementary motors. It should also be noted that, when two elementary motors have cylinder capacities that are close to each other, they are used in opposition, i.e. with one motor active and the other opposing, these two elementary motors advantageously having a very high maximum-to-minimum ratio, without the smallest cylinder capacity of an elementary motor being particularly small.

Arranging elementary motors in a manner such that their respective cylinder capacities are different may be achieved in various manners:

- by providing different numbers of lobes between the "by-lobe" elementary motors;
- by providing different numbers of cylinders between the "by-cylinder" elementary lobes;
- by providing cam lobes of different depths between the "by-lobe" elementary motors: thus the strokes of the pistons vary as a function of the lobes on which they are acting, and the cylinder associated with the lobe varies depending on the lobe; or
- by providing cylinder capacities that are different between "by-cylinder" elementary motors, and in particular cylinders that, for the same stroke (the same movement between a top dead center and a bottom dead center of the cam), move different volumes of fluid: the cylinder capacities of said cylinders are then, by definition, different.

In an embodiment of the invention, the control system includes an activation table that indicates and makes it possible to determine the operating modes of the various elementary motors as a function of a desired cylinder capacity, each operating mode being chosen from among drive, opposing, and inactive. The total cylinder capacity of the circuit is obtained by adding or subtracting the respective cylinder capacities of the elementary motors in drive or opposing mode.

The purpose of the activation table can be better understood by considering, for example, a motor with two sub-motors of respective cylinder capacities Cyl1 and Cyl2. The number of cylinder capacities of the motor is presented by the following activation table:

| Sub-motor 1 | | | Sub-motor 2 | | | Cylinder |
|---|---|---|---|---|---|---|
| RR 1 | FR 1 | | RR 2 | FR 2 | | capacity |
| 0 | 0 | LP Inactive | 0 | 0 | LP Inactive | 0 |
| 0 | 0 | LP Inactive | 1 | 1 | HP Inactive | 0 |
| 1 | 1 | HP Inactive | 0 | 0 | LP Inactive | 0 |
| 1 | 1 | HP Inactive | 1 | 1 | HP Inactive | 0 |
| 1 | 0 | Drive | 1 | 0 | Drive | Cyl1 + Cyl2 |
| 1 | 0 | Drive | 0 | 0 | LP Inactive | Cyl1 |
| 1 | 0 | Drive | 1 | 1 | HP Inactive | Cyl1 |
| 0 | 0 | LP Inactive | 1 | 0 | Drive | Cyl2 |
| 1 | 1 | HP Inactive | 1 | 0 | Drive | Cyl2 |
| 1 | 0 | Drive | 0 | 1 | Opposing | Cyl1 − Cyl2 |
| 0 | 1 | Opposing | 0 | 1 | Opposing | −Cyl1 − Cyl2 |
| 0 | 1 | Opposing | 0 | 0 | LP Inactive | −Cyl1 |
| 0 | 1 | Opposing | 1 | 1 | HP Inactive | −Cyl1 |
| 0 | 0 | LP Inactive | 0 | 1 | Opposing | −Cyl2 |
| 1 | 1 | HP Inactive | 0 | 1 | Opposing | −Cyl2 |
| 0 | 1 | Opposing | 1 | 0 | Drive | −Cyl1 + Cyl2 |

where:

- the rising ramps and the falling ramps of the first sub-motor and of the second sub-motor are respectively referenced RR1 & FR1 and RR2 & FR2;
- "1" indicates that a ramp of a lobe of the cam is connected to the high-pressure main duct, and "0" indicates that it is connected to the low-pressure main duct;
- "LP Inactive" or "HP Inactive" indicate respectively an elementary motor having the rising and falling ramps of its various lobes connected to the low-pressure (0) main circuit or to the high-pressure (1) main circuit.

The motor thus has four different cylinder capacities that are reversible, and symmetrical, and a plurality of different inactivation modes. This activation table shows that each elementary motor can be placed in one or the other of the provided operating modes (drive, opposing, high-pressure (HP) inactive or low-pressure (LP) inactive), giving rise to the total cylinder capacity of the motor in the chosen operating mode.

In addition, in the motor of the invention, the control of the distribution valves is preferably chosen in such a manner as to use the various cylinder capacities of the motor to optimize the management of the motor, as a function of the desired behavior, in terms, in particular, of speed of rotation, of consumed fluid flow rate, of delivered torque, etc. This optimization of the control is facilitated by the following different improvements:

In an embodiment, the control system is adapted for automatically effecting a plurality of cylinder capacity changes in a predefined order. For example, an operating mode that is desired for a motor (speed, cylinder capacity, etc.) may be given as a setpoint to the control system of the motor; the control system then determines the sequence of the cylinder capacities to be implemented in order to put the motor in the desired operating mode. In particular, in an embodiment, the control system is suitable for operating the distribution valves in a manner such as to adjust the cylinder capacity progressively as a function at least of a speed of rotation of the motor and of a setpoint transmitted to the motor, in particular a speed setpoint, while going through at least one intermediate cylinder capacity between the current cylinder capacity and the cylinder capacity corresponding to the required speed.

In particular, in an embodiment, the control system is suitable for automatically effecting a plurality of cylinder capacity changes in a predefined order, as a function at least of a speed of rotation of the motor and of a speed or acceleration setpoint transmitted to the motor. For example, in order to increase the speed progressively, while the required drive torque is decreasing, the control system progressively reduces the cylinder capacity of the motor by causing it to operate successively with smaller and smaller cylinder capacities. Preferably, to this end, the control system includes an ordered table of the various cylinder capacities and of the associated operating modes of the various elementary motors.

In an embodiment, the control system causes a flow rate delivered to an elementary motor and the cylinder capacity to be varied in substantially simultaneous manner, in order to keep the speed of said elementary motor constant.

Advantageously, in the above-mentioned embodiments that make it possible for certain cylinder capacity changes to be made automatically, the driver of the vehicle is relieved of the need to perform cylinder capacity selection operations, which are handled in partially automatic manner by the control system.

In an embodiment, when the motor is in one of said states, the control system is suitable for operating the distribution valves, in such a manner that two elementary motors exert torque in opposite directions. In other words, one of said elementary motors is in drive mode, while the other is in opposing mode. The apparent cylinder capacity of the assembly made up of the two elementary motors is equal to the difference in their respective cylinder capacities. If the elementary motors have cylinder capacities that are close to each other, the resulting cylinder capacity is thus very small. This thus advantageously makes it possible, in simple manner, to form a motor having a very high maximum-to-minimum ratio.

For example, it is possible to design a motor in which the larger of the two cylinder capacities does not exceed 1.5 times the smaller cylinder capacity. This arrangement makes it possible to obtain a high maximum-to-minimum ratio for the motor. If, for example, the larger cylinder capacity is equal to $1.5\times C$, where C is the smaller cylinder capacity, the maximum-to-minimum ratio is equal to $(1.5C+C)/(1.5C-C)$, i.e. equal to 5.

In an embodiment, when the motor is in said state, the elementary motors are constant-velocity motors. Such elementary motors are characterized by the fact that a constant pump flow rate results in a constant speed of rotation for any angular positions between the cam and the cylinder block. The use of constant-velocity elementary motors imparts increased operating stability and increased lifespan to the motor. These properties are particularly important for low-speed motors such as motors for driving the wheels of a vehicle of the construction or farm vehicle type.

In addition, the motor of the invention may be operated in a state in which at least one elementary motor is in inactive mode. This operating mode can be optimized in the following manner:

In an embodiment, the fluid distributor has, for at least one elementary motor, inactivation means suitable for connecting said elementary motor in continuous manner to the main duct having a pressure chosen from among the lower pressure and the higher pressure of the main ducts. Advantageously, since the elementary motor is connected to the lower-pressure main duct, the residual torque proportional to the pressure that it generates, which residual torque is very low, is minimized by means of the fact that the fluid pressure is minimal in the cylinders of the elementary motor.

The selector may be implemented in various manners.

In an embodiment, the inactivation means include means for detecting the direction of rotation of the motor, said chosen pressure being selected as a function of the direction of rotation of the motor and of the direction of a speed command or of an acceleration command that is applied to the motor. Knowing the direction of rotation of the motor and the direction of the (speed or acceleration) command, the control system can deduce therefrom the direction of the flow of fluid passing through the motor and thus determine that one of the main ducts of the circuit to which it is opportune to connect the inactive elementary motor(s). Advantageously, with this technical solution for selecting the lower pressure, the motor does not need any pressure sensor.

In an embodiment, the inactivation means include a detector suitable for detecting the main duct that is at the lower pressure from among the main ducts. For example, the inactivation means include pressure sensors disposed in the two main ducts, so as to detect the lower of the pressures in these circuits in order to maximize the efficiency of the elementary motors in the drive stages and in the braking stages.

In addition, in an embodiment, causing the first elementary motor to go over to inactive mode, when the motor is in the above-mentioned second state, can be achieved by means of the fact that, at least for one elementary motor, the pistons are suitable for being retracted, such that they are disengaged from the cam. In this way, the pistons—or the cylinders in which the pistons are situated—no longer generate any braking torque, and the efficiency is thereby much improved. For the cylinders in question, this embodiment usually needs a particular valve with at least 3 positions. It should be noted that, in the elementary motor in question, there can be only one piston (and cylinder).

In an embodiment, when the motor is in said states, the control system is suitable for operating the distribution valves, in such a manner as to reverse the direction of rotation of an outlet member of the motor without reversing the input and output directions of the fluid in the motor. For example, the control system operates the valve means in such a manner that the sum of the cylinder capacities of the elementary motors in opposing mode, which sum is initially less than the sum of the cylinder capacities of the elementary motors in drive mode, becomes greater than said sum of the cylinder capacities of the elementary motors in drive mode, thereby causing the direction of rotation of an outlet member of the motor to be reversed. As can be understood, this reversal of the direction of rotation of the motor takes place without reversing the direction of the flow of fluid driven by the pump. Advantageously, it is thus possible to use a simple pump and it is not necessary to use a flow-reversing pump.

In analogous manner, in an embodiment, when the motor is in said sates, the control system is suitable for operating the distribution valves in such a manner as to maintain the direction of rotation of an outlet member of the motor constant, during a reversal of input and output directions in which the fluid is input and output through the motor. Such operation is useful, above all, when the motor is fed via pressure accumulators, with which accumulators the direction of the fluid is more likely to change or to be reversed suddenly than with a pump.

In an embodiment, at least one distribution valve is a valve having at least two positions and at least three orifices, a first orifice connected to a chamber of a cylinder, and second and third orifices that are connected respectively to two main ducts of the motor; the valve having a first position in which it connects the chamber of the cylinder to a first main duct, and a second position in which it connects said chamber to another main duct. In certain cases, the distribution valve can also have other positions, e.g. positions in which rather than connecting the chamber of the cylinder to main ducts connected to the pump, it connects the chamber of the cylinder to main ducts connected to pressure accumulators, for example.

A motor of the invention may, in addition, receive various improvements making it possible to optimize the amount of volume it occupies:

In a first embodiment, in the hydraulic motor, the fluid distributor is disposed substantially at the same level along the axis of rotation as the cylinder block. By means of this arrangement, no space is used up by a port plate, and the length of the motor along the axis of rotation is thus minimized.

In a second embodiment, the hydraulic motor includes a shaft inside which at least one duct passes, making it possible to transmit fluid or information to a member driven by the motor. This duct may serve, in particular as a fluid, liquid, or gas feed, or it may contain an electric cable or an optical fiber, for a member driven by the motor. In certain embodiments, the shaft may be hollow, making it possible to obtain a motor of large diameter, but of relatively light weight.

The invention also provides a hydraulic circuit including at least one first hydraulic motor as defined above, coupled to a first movement member for moving a vehicle; and at least one second motor, coupled to a second movement member for moving a vehicle; the control system of the first motor being suitable for causing the first motor to rotate, and thus for causing the first motor and thus the first movement member to rotate, at a speed that is different from the speed of the second movement member or in a direction that is opposite from the direction of the second movement member. The fact that the movement members are driven at different speeds, or indeed in opposite directions, causes the vehicle to turn. If the movement members are merely driven at different speeds, the vehicle follows a curve; if they are driven in opposite directions, the vehicle turns on the spot. These possibilities are particularly advantageous for vehicles having a small amount of maneuvering space, such as, for example, certain farm vehicles.

The use of these motors also makes it possible to form an anti-spin system by reducing the cylinder capacity of one motor (or indeed by reducing it to zero) in the event that the speed of the wheel is too high relative to the speeds of the other wheels of the vehicle.

Finally, the invention provides a hydraulic circuit including at least one hydraulic motor as defined above, and at least two pressure accumulators, connected to two main ducts of the motor. Advantageously, the two pressure accumulators may be used for storing energy in the form of fluid pressure, during the braking stages, and for delivering drive work during the drive stages. The above-described reversal mode then makes it possible, while maintaining the same direction of rotation, to reverse the flow through the motor so that said motor is fed by the energy reserve in acceleration mode, and fills said reserve in braking mode. The pressure accumulators also make it possible to decouple operation of the pressurized fluid source feeding the motor from operation of the motor itself. The large number of cylinder capacities of this motor makes it possible to choose the torque (drive torque or braking torque) to be applied to the shaft of the motor. It is also possible, without adding any additional valve, to deactivate the motor totally by deactivating all of the elementary motors (causing them to go over to inactive mode).

Two embodiments are more particularly conceivable for such a hydraulic circuit:

In a first embodiment, said at least one motor includes a selector interposed on the main ducts and having at least two positions, namely a first position that makes it possible to connect the motor to the pump, and a second position that makes it possible to connect the motor to the pressure accumulators. In this circuit, the pressure accumulators are designed to be suitable for temporarily or permanently replacing the pump or the pressurized fluid source delivering to the motor the energy that enables it to operate.

In a second embodiment, the hydraulic circuit includes at least one motor as defined above, and at least two pressure accumulators, connected to two main ducts of the motor; the motor including:

- two first main ducts connected to the two pressure accumulators;
- two second main ducts connected to the main orifices of a pressurized fluid source other than said pressure accumulators, e.g. a pump;
- a first group of at least one elementary motor, the distribution valves of which are suitable for connecting the cylinders of said at least one elementary motor of the group to said first main ducts; and
- a second group of at least one elementary motor, the distribution valves of which are suitable for connecting the cylinders of the at least one elementary motor of the group to said second main ducts.

In general, this embodiment is used when the elementary motors are "by-cylinder" elementary motors. In this situation, in the motor, the cylinders of elementary motors forming a first group are connected to main ducts that are connected to the pump, while the cylinders of the remaining elementary motors are connected to main ducts connected to pressure accumulators.

Finally, an object of the invention is to provide a method of controlling a hydraulic motor having radial pistons, said motor including:

- a cylinder block, in which each cylinder has a chamber in which a piston is mounted to slide;

a cam, on which each of the pistons can exert pressure in order to generate torque, the cam having at least two lobes, each lobe having a rising ramp and a falling ramp, the cylinder block being mounted to rotate relative to the cam;

at least two main ducts, via which the motor can receive or send fluid;

a fluid distributor for distributing the fluid from said main ducts to the cylinders, which distributor includes, for each cylinder, a distribution valve suitable for connecting the chamber of the cylinder to one or the other of said main ducts, so as to enable fluid to enter into or to exit from said chamber; and a control system including an angular position sensor for sensing the angular position of the cam relative to the cylinder block, for controlling the distribution valves;

that makes it possible to obtain a plurality of operating cylinder capacities, but without suffering from the above-mentioned drawbacks of instability, of vibration, and of significance of the forces applied to the structure of the motor during operation.

This object is achieved by means of the fact that, according to the method:

with the motor including at least two elementary motors;

the motor is operated in at least a first and a second operating state by means of the distribution valves;

in each of said states, in each elementary motor, each of the cylinders is put into communication on the rising ramps with a first main duct and on the falling ramps with a second main duct that is distinct or not distinct from the first main duct, any changes to these communications taking place when the cylinder passes substantially facing a top or bottom dead center, on the basis of the information delivered by the angular position sensor; in the first state, a first elementary motor is driving; and in the second state, the first elementary motor is inactive or opposing; the control system operating the remainder of the hydraulic motor in the same way in said first and second states.

The invention can be well understood and its advantages appear more clearly on reading the following detailed description of embodiments shown by way of non-limiting examples. The description refers to the accompanying drawings, in which.

Figure 6C:
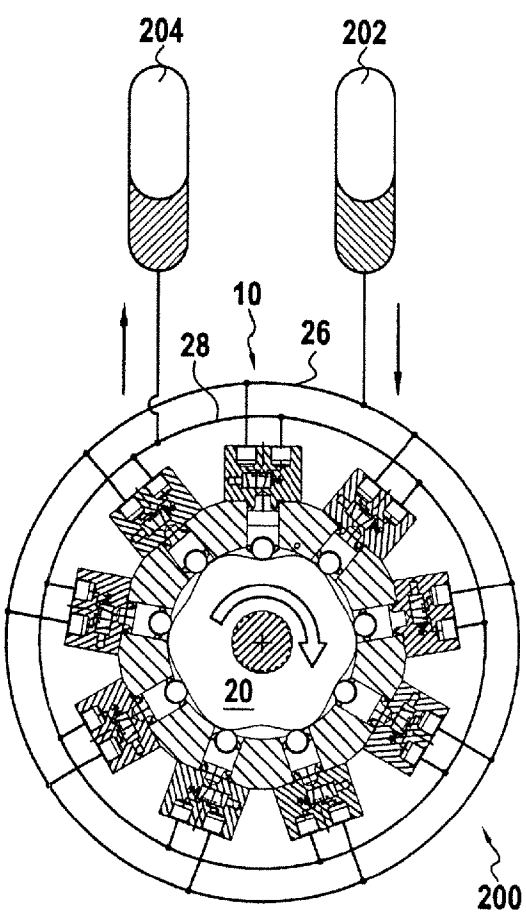
Figure 6B:
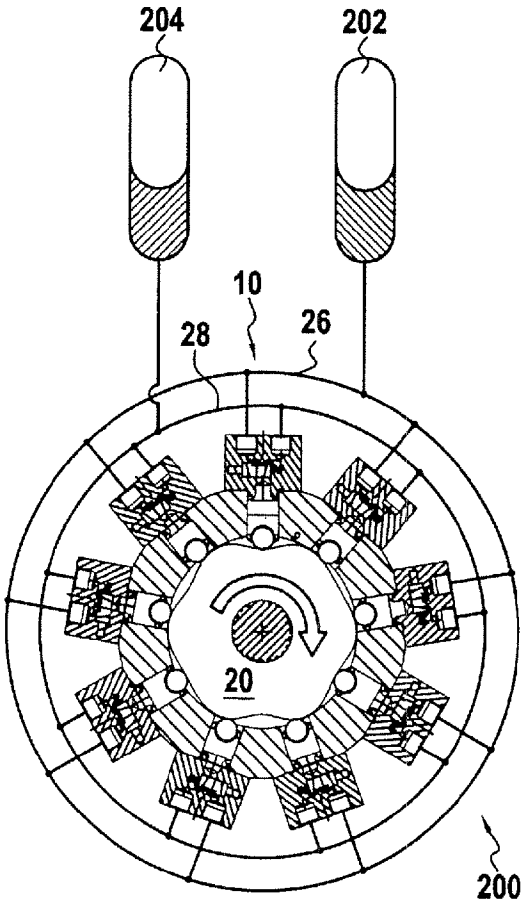
Figure 6A:
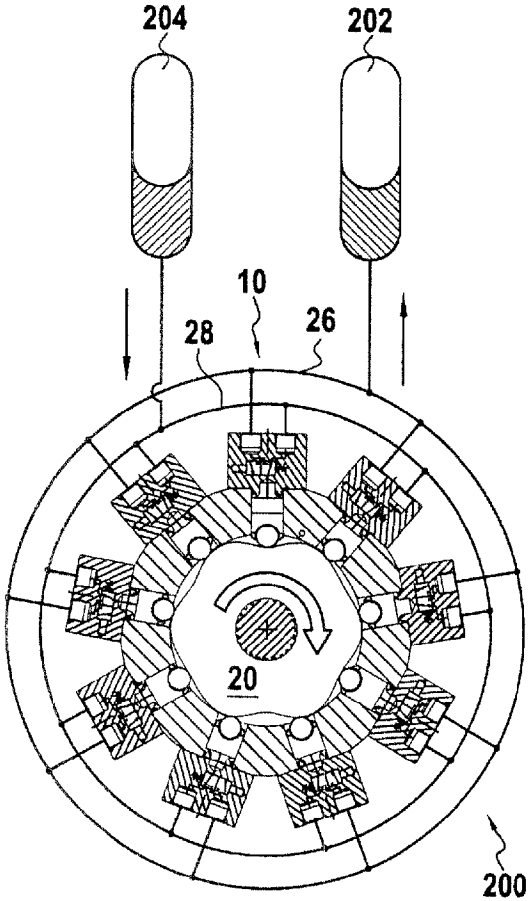
Figure 7A:
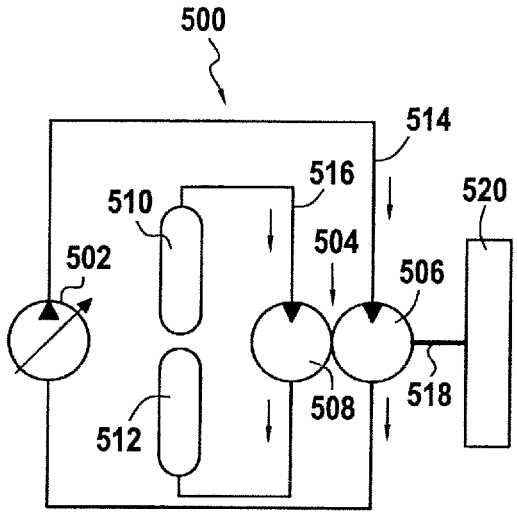
Figure 7B:
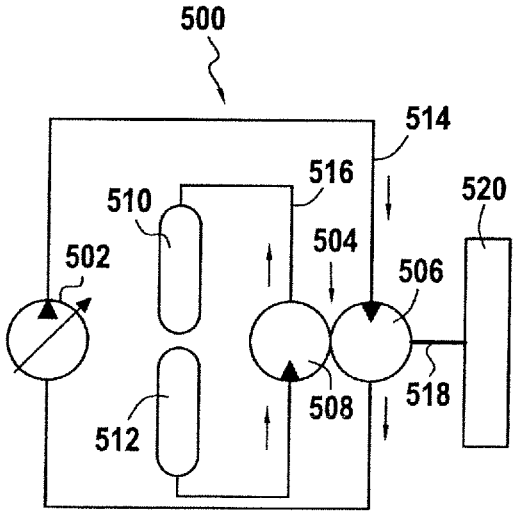
Figure 8A:
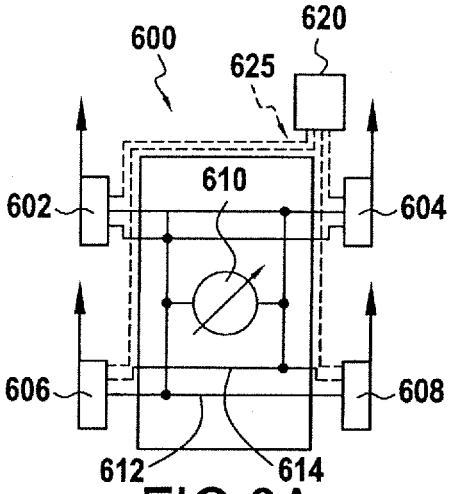
Figure 8B:
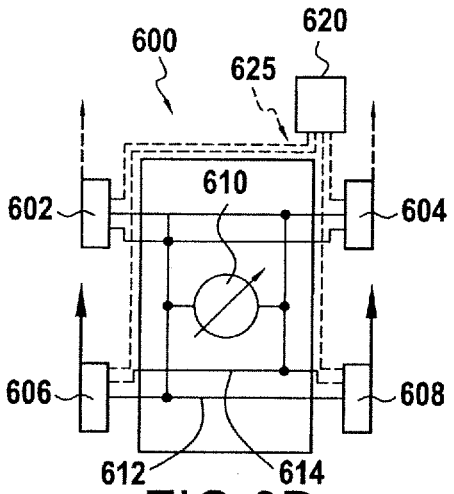
Figure 8C:
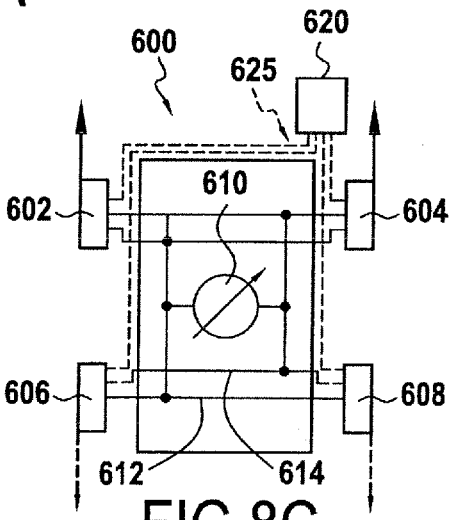
Figure 8D:
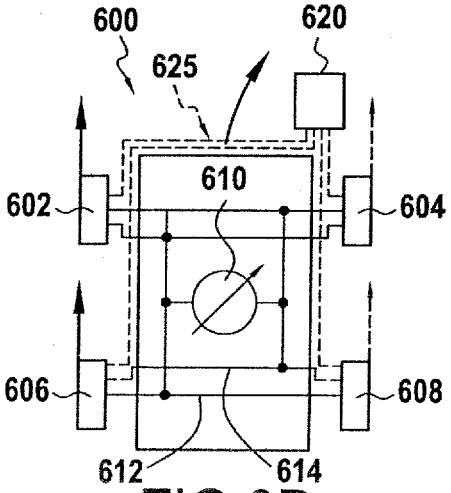
Figure 8E:
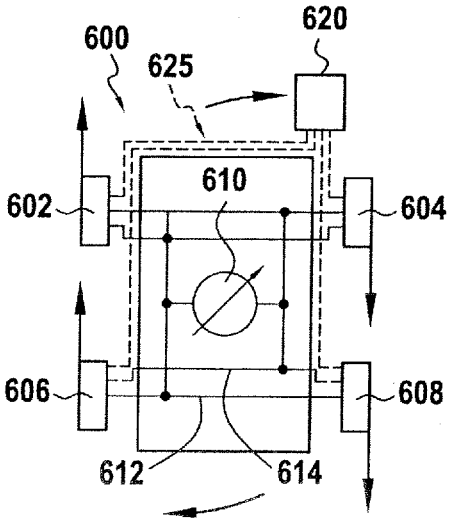

FIGS. 6A, 6B, and 6C are diagrammatic axial section views of a hydraulic motor of the invention, including two pressure accumulators; in which motor the elementary motors are used respectively in drive mode, in inactive mode, and in opposing mode;

FIGS. 7A and 7B are diagrammatic views of hydraulic circuits each including a motor of the invention coupled to a distinct wheel and fed by pressure accumulators; and FIGS. 8A to 8E are diagrammatic views of a hydraulic circuit having four motors of the invention, used in different operating configurations.

A hydraulic motor 10 of the invention is described below with reference to FIGS. 1 to 4.

The motor 10 includes an outer casing 15 in three portions, namely a holding portion 11, a cylinder block 12, and a cover 13. The three portions are fastened together by screws 7.

The holding portion 11 is provided with through fastening holes 9 that enable the motor 10 to be fastened to the frame (not shown) of the vehicle on which the motor 10 is fastened.

The cover 13 closes the internal chamber 8 of the motor 10, in which chamber the cam 20 and the shaft 24 rotate relative to the remainder of the motor.

The cylinder block 12 has nine cylinders 14 referenced individually by references 14A to 14I. Each cylinder 14 has a chamber 16 in which a piston 18 slides. The cylinder block 12 is mounted to rotate, relative to the cam 20.

The cam 20 is mounted on a central shaft 24 of the motor, which shaft defines the axis of rotation X of the motor. The two elements are secured together by fluting 21 that makes it possible for the cam 20 to mesh with the outside periphery of the shaft 24.

The shaft 24 is a shaft in two portions 24A and 24B that are fastened by screws 23 disposed along the axis of rotation X.

The shaft 24 is held relative to the casing 15 of the motor by means of two conical rolling bearings 19, disposed between the shaft 24 and the holding portion 11 of the casing 15.

The end of the shaft 24 that is disposed on the same side as the holding portion 11 is shaped into a flange 25. The flange has through fastening holes 27 and serves to fasten to a member driven by the motor 10 that may be a wheel, a tool, etc. (not shown).

At its radially inner end, each piston 18 is provided with roller 22 designed to transmit a force to the cam 20. The resultant of the forces exerted by the pistons generates torque transmitted by the pistons 18 to the shaft 24 of the motor.

The motor 10 is fed with fluid via two main ducts 26 and 28, via which the motor receives or sends fluid.

The motor 10 further includes a fluid distributor 30 which, for each cylinder, has a distribution valve 32 suitable for connecting the chamber 16 of the cylinder to one or the other of said main ducts, so as to enable fluid to enter into and to exit from said chamber.

The distribution valves are disposed on the outside periphery of the cylinder block 12. The fluid distributor 30 is thus disposed axially substantially at the same level as the cylinder block, and the motor 10 is thus remarkably compact in the axial direction.

The distribution valves 32 are controlled by a control system 34 constituted essentially by an electronic computer. This control system 34 transmits the commands to the distribution valves 32 by means of a wired or wireless network 37.

In order to enable the control system 34 to operate the various distribution valves 32, in a manner adapted as a function of the position of the cam 20, the motor also includes an angle sensor 35, as means for detecting the relative position of the cam 20 relative to the cylinder block 12 and thus for detecting the direction of rotation of the motor 10.

The distribution valve fluid distributor 30 is also provided with a detector for detecting the main circuit that is of lower pressure, which detector is constituted mainly by two pressure sensors 39 that acquire the pressures in the main ducts 26 and 28, and that are associated with the control system 34, to which they transmit the measured pressure values. On the basis of these pressure measurements, the control system 34 is suitable, at any time, for determining that one of the circuits 26 or 28 that is at the lower pressure. The detector of the lower-pressure main circuit constituted in this way thus enables certain elementary motors to be rendered inactive by connecting them to the lower-pressure main circuit, thereby minimizing the residual braking torque induced by said elementary motors.

The cam 20 is an internal cam, disposed inside the cylinder block 12, and it has six lobes 36, each lobe having a falling ramp 36' and a rising ramp 36", for the direction of rotation indicated by the arrow A.

The motor 10 can be used in various different operating states. These operating states of the motor 10 are provided for a specific grouping-together of lobes and of cylinders, defining elementary motors. Taking account of these elementary motors, in the various operating states that are provided, the control system 34 issues commands such that, in each elementary motor, the cylinders acting on rising ramps of a group of lobes are put into communication with a first main duct, and the cylinders acting on falling ramps are put into communication with a second main duct, distinct or non-distinct from the first main duct, the switching of the distribution valves taking place when the cylinders pass substantially facing a top or bottom dead center of the cam 20.

The same motor 10 can be used with its elementary motors being in a plurality of configurations.

Figure 1:
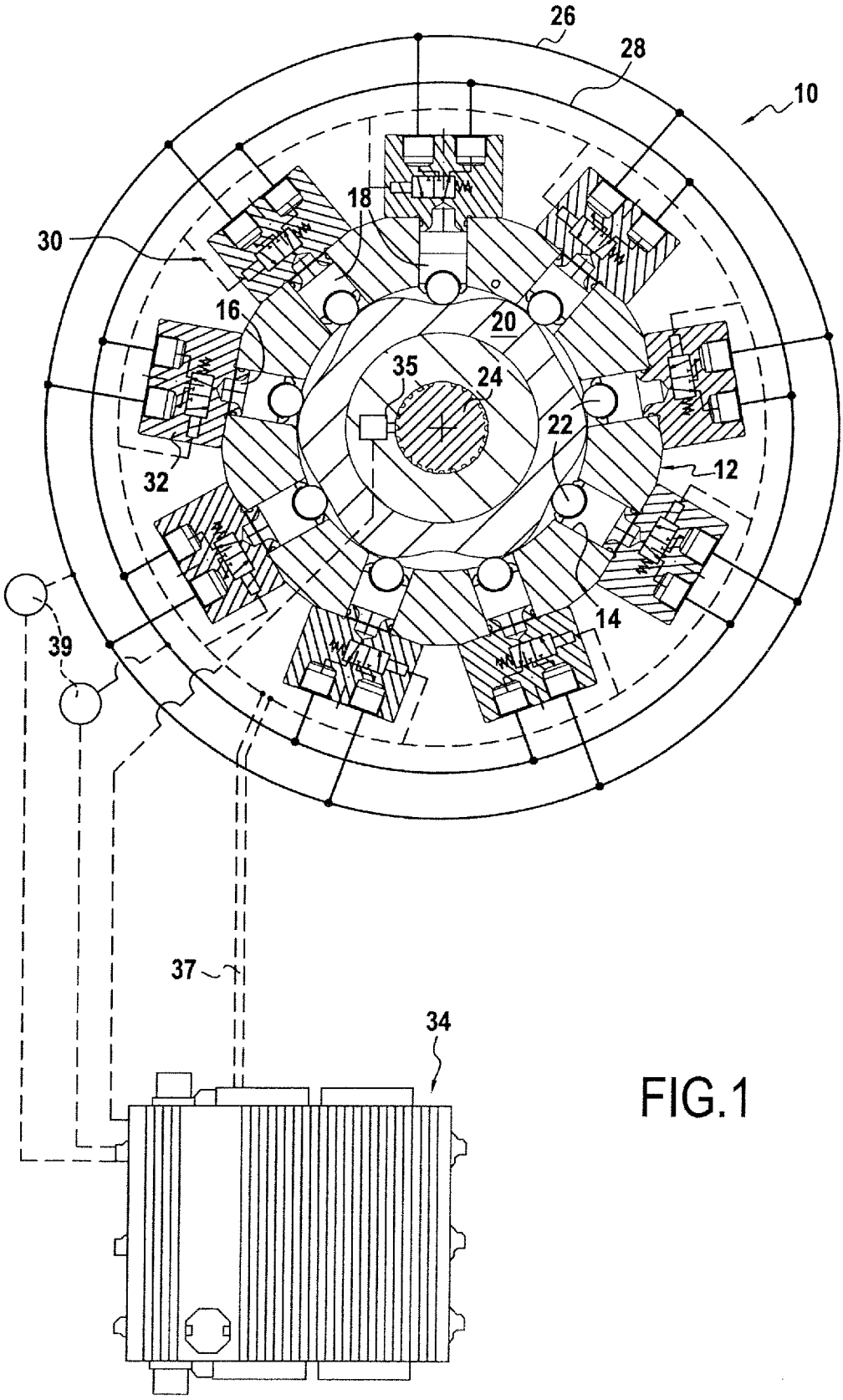
FIGS. 1 and 2 are diagrammatic views of the structure of a hydraulic motor of the invention, respectively in axial section and in longitudinal section for showing the valve units of FIG. 1 more clearly.
Figure 2:
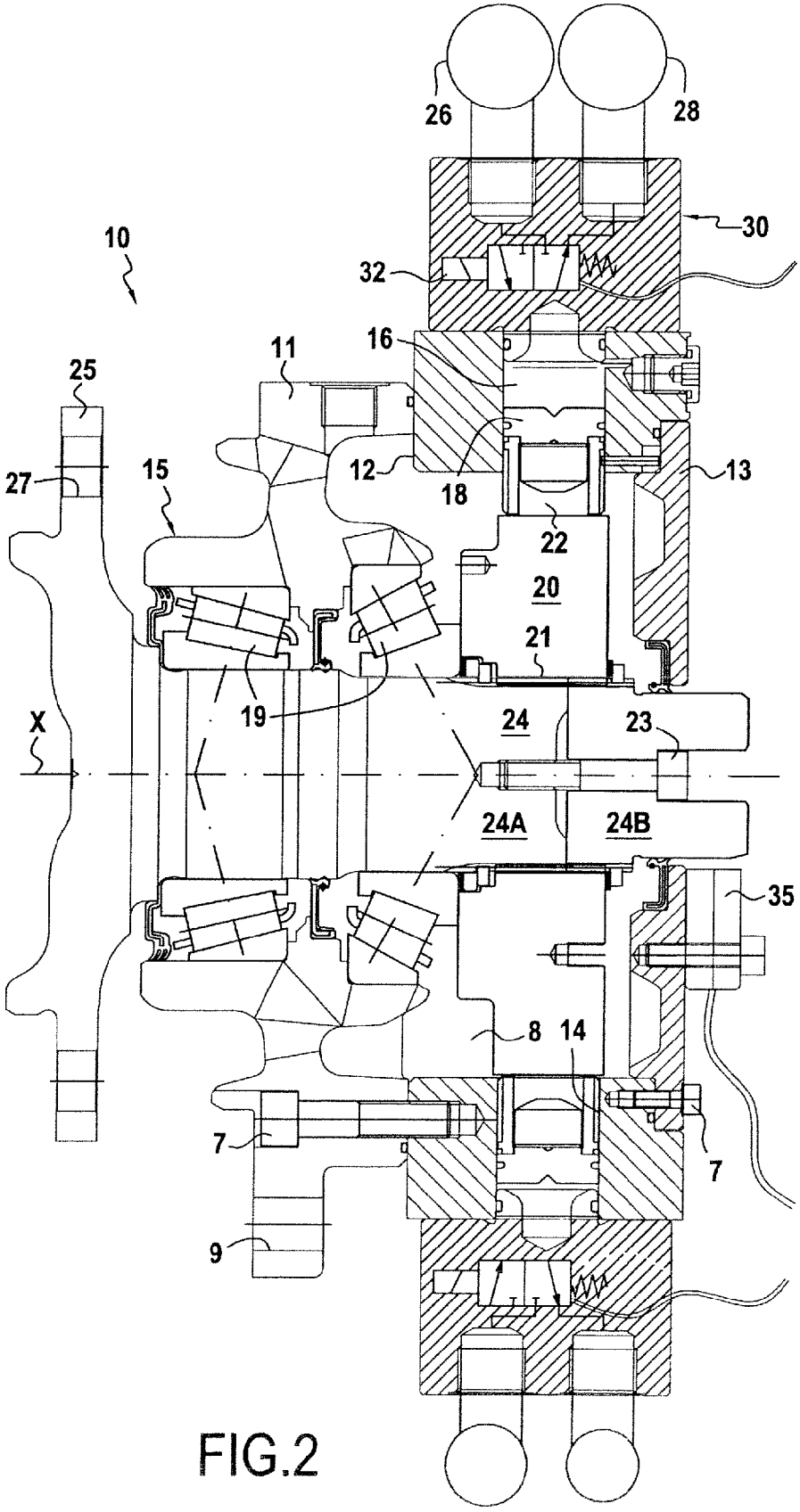
Figure 3:
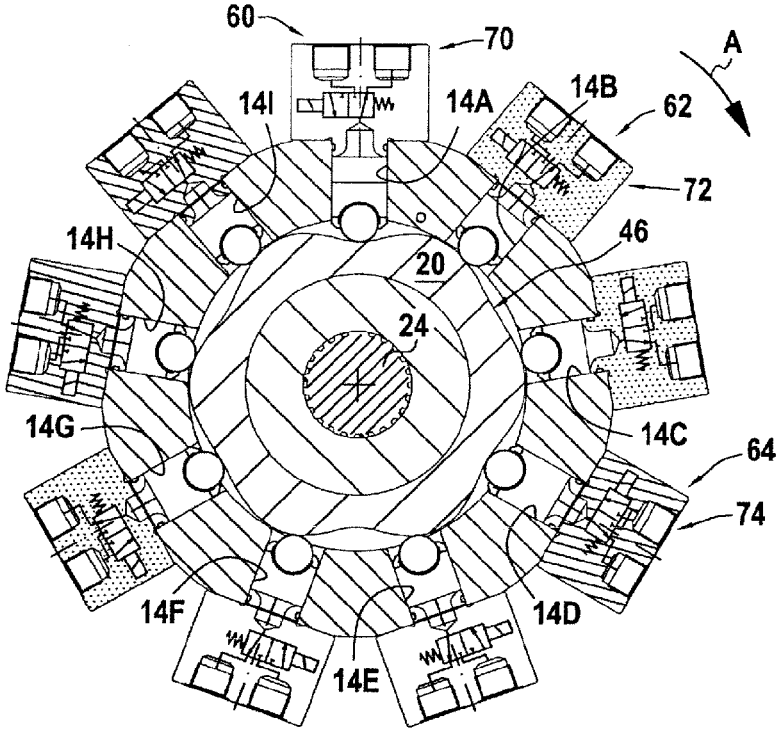
FIG. 3 is a fragmentary axial section view of the motor of FIG. 1, showing a first distribution of the lobes and of the cylinders, which distribution, when associated with a first type of control of operation of the motor 10, constitutes a first embodiment of the invention, in which embodiment the elementary motors are said to be "by-cylinder elementary motors"
Figure 4:
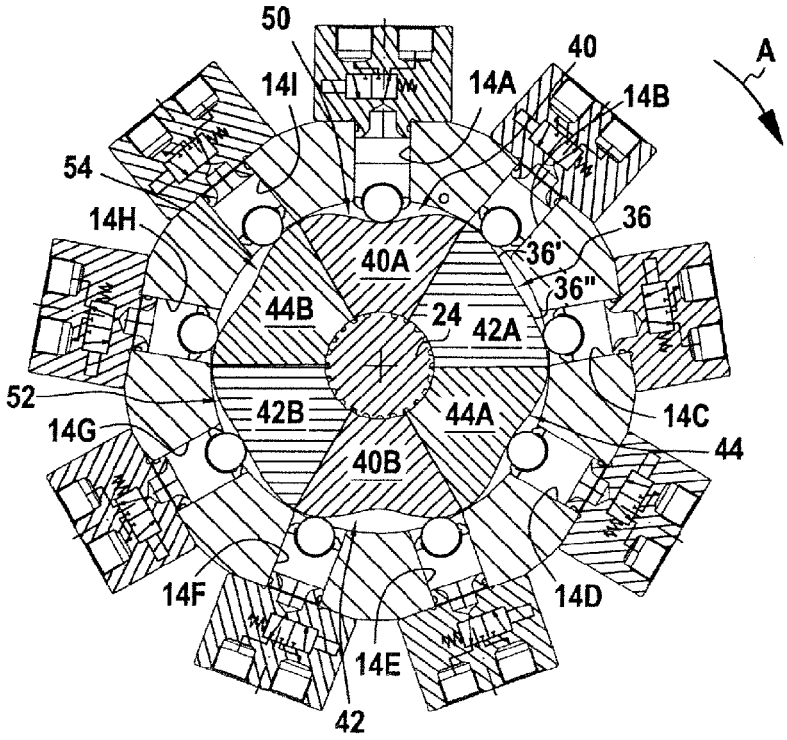
FIG. 4 is a fragmentary axial section view of the motor of FIG. 1, showing a second distribution of the lobes and of the cylinders, which distribution, when associated with a second type of control of operation of the motor 10, constitutes a second embodiment of the invention, in which embodiment the elementary motors are said to be "by-lobe elementary motors"

Thus, two different distributions of elementary motors, referred to respectively as "by-lobe" distribution and "by-cylinder" distribution are shown respectively in FIGS. 3 and 4. Each of these distributions constitutes an embodiment of the invention.

To facilitate understanding, in FIGS. 3 and 4, only the inner portion of the casing of the motor 10 is shown.

A first configuration of the elementary motors of the motor 10 is shown in FIG. 3. In this embodiment of the invention, the lobes are distributed in a single group 46 of lobes. The cylinders are distributed in three groups of cylinders 60, 62, 64, respectively including the cylinders 14A, 14E, & 14F; 14B, 14C, & 14G; and 14D, 14H & 14I of the motor 10 (in FIG. 3, each group is identified by a particular type of shading of the piston).

Taking account of the presence of a single group 46 of lobes, and of three groups 60, 62, 64 of cylinders, the motor has three elementary motors 70, 72, 74. In this example, each elementary motor is defined by a group of cylinders, regardless of the positions of said cylinders relative to the lobes of the motor.

In this embodiment, the control system 34 is designed to operate the distribution valves in such a manner that, in a steady state, in each elementary motor 70, 72, 74, the cylinders acting on rising ramps are put into communication with a first main duct (26 or 28); and the cylinders acting on falling ramps are put into communication with a second main duct (26 or 28). For example, if the elementary motor (or group of cylinders) is active, the cylinders acting on rising ramps are put into communication with the higher-pressure main duct, while the cylinders acting on falling ramps are put into communication with the lower-pressure main duct.

A second distribution of the elementary motors of the motor 10 is shown in FIG. 4. In this second embodiment of the invention, the lobes are distributed into three groups 40, 42, 44 of complementary lobes. Each of said groups 40, 42, 44 has two respective lobes 40A & 40B, 42A & 42B, and 44A & 44B. Each of said groups 40, 42, 44 is asymmetric and has symmetry of order 2 about the axis of rotation X.

In addition, the cylinders are distributed in a single group of cylinders, comprising all of the nine cylinders 14A-14I of the motor 10.

Taking account of the presence of three groups of lobes, and of a group of cylinders, the motor has three elementary motors 50, 52, 54. In this example, each elementary motor is defined by the set of cylinders acting on the lobes of the group of lobes assigned to the elementary motor. Thus, the elementary motor 50 has the lobes 40A and 40B, the group 52 has the lobes 42A and 42B, and the group 54 has the lobes 44A and 44B. When the cylinders are in the position shown in FIG. 4, the elementary motor 50 has the cylinders 14A, 14E, & 14F; the elementary motor 52 has the cylinders 14B, 14C, & 14G; and the elementary motor 54 has the cylinders 14D, 14H, & 14I. Naturally the assignment of the cylinders to the various elementary motors varies as a function of time.

In this embodiment, the control system 34 is suitable for operating the distribution valves in such a manner that, in each elementary motor 50, 52, 54, the cylinders acting on rising ramps of a group of lobes are put into communication with a first main duct (26 or 28); and the cylinders acting on falling ramps are put into communication with a second main duct (26 or 28) distinct or not distinct from the first main duct.

For example, in the configuration in which only the elementary motor 50 is active, the cylinders acting on rising ramps of the group of lobes 40A and 40B are put into communication with a first main duct (26 or 28); and the cylinders acting on falling ramps are put into communication with a second main duct (26 or 28) distinct or not distinct from the first main duct. Conversely, all of the other cylinders acting on the ramps of the other lobes 42A & 42B, and 44A & 44B are put into communication with the same main duct (advantageously, the main duct at the lower pressure) in such a manner as to render the other elementary motors 52 and 54 inactive.

In the two embodiments described, and respectively shown in FIGS. 3 and 4, the various elementary motors are constant-velocity motors, and have equal cylinder capacities.

It should be noted that other embodiments may be implemented on the basis of the motor as shown in FIG. 3 or 4. These embodiments are obtained on the basis respectively of the first embodiment and of the second embodiment, e.g. merely by considering that two of the elementary motors form a single motor, and by excluding all of the modes of control of the distribution valves that are incompatible with this principle. In the remaining operating modes, the motor appears as a motor comprising two elementary motors, having respective cylinder capacities that are different, e.g. in a ratio of 1/3 to 2/3.

Figure 5:
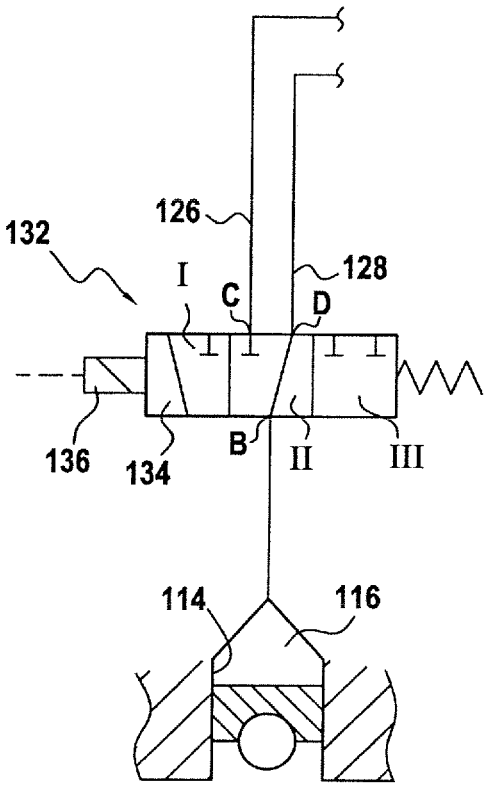
FIG. 5 is a diagrammatic view of a distribution valve of a motor of the invention.

FIG. 5 is a diagrammatic view showing the structure of a distribution valve 132 that is usable in a motor of the invention.

The distribution valve 132 has three orifices B, C, D that are: a first orifice B connected to a chamber 116 of a cylinder 114, and second and third orifices C and D that are connected to two main ducts of the motor 126 and 128.

In a first position I, the valve 132 connects the chamber 116 of the cylinder 114 to the main duct 126; in a second position II, it connects the chamber 116 to the other main duct 128. The valve 132 is a solenoid valve that is caused to move by an electronic control unit (e.g. the control unit 34). It has a slide 134 actuated by an electric actuator 136. Alternatively, it is possible to use, as a distribution valve, a valve having a slide that is actuated by the pressure prevailing in a hydraulic control chamber rather than by an electric actuator.

In general, the distribution valve may have return means and one or two pilot means enabling it to remain in two stable positions, corresponding to the chamber of a cylinder being put into communication respectively with one or the other of the main ducts of the motor (there generally being two such ducts, one being at a high pressure for feed purposes, and the other being at a low pressure for discharge purposes).

The valve 132 shown in FIG. 5 has a third position III serving for inactivating the cylinder in the retracted position. In the position III, the valve 132 isolates the main ducts 126 and 128 from the chamber 116. This third position can be used, for example, when the piston can be retracted into the chamber of the cylinder, into a position in which it no longer comes into contact with the cam.

With embodiments of a hydraulic motor of the invention being described above, a description follows of how such a motor can be incorporated into various hydraulic circuits.

Various different arrangements are possible for implementing a hydraulic circuit including a motor of the invention, and, in particular, by associating said motor with pressure accumulators, for its feed and for its discharge.

An example of a hydraulic circuit 200 is shown in FIGS. 6A to 60. In this circuit, all of the elementary motors of the same motor 10 are connected via main ducts 26 and 28 that are common to all of the cylinders respectively to two accumulators 202 and 204.

The hydraulic circuit 200 mainly includes a motor 10 identical to the motor described with reference to FIGS. 1 to 4, a low-pressure (LP) pressure accumulator 202, and a high-pressure (HP) pressure accumulator 204. These two pressure accumulators have capacities, suitable for receiving a quantity of hydraulic fluid in a chamber and having a second gas chamber of identical pressure. The pressure in the gas chamber varies as a function of the extent to which the pressure accumulator is filled with fluid.

The pressure accumulators 202 and 204 are connected to respective ones of the main ducts 26 and 28 of the motor 10 that are designed for enabling fluid to be exchanged with the main ducts.

The various operating modes of the hydraulic circuit 200 are shown by FIGS. 6A, 6B, and 6C:

In drive mode (FIG. 6A), the motor 10 is fed via the HP accumulator 204, and its discharge is directed towards the LP accumulator 202. Operation of the motor progressively reduces the pressure in the HP accumulator 204, and increases it in the LP accumulator 202.

In braking mode (FIG. 6C), the motor 10 is fed by the LP accumulator 202, and its discharge is directed towards the HP accumulator 204. Conversely to the drive mode, the braking mode makes it possible to increase the pressure in the HP accumulator, while reducing the pressure in the LP accumulator.

In inactive mode (FIG. 6C), the feed and the discharge of the motor 10 are connected to the same main duct, which is preferably the low-pressure duct. The motor 10 generates almost no torque, except for low retaining torque.

When the motor 10 is a drive motor for driving movement members for moving a vehicle, it should be noted that the three preceding modes can be implemented, regardless of whether the vehicle is in forward mode or in reverse mode, by transmitting a command to the distribution valves in the appropriate direction.

As a function of the pressure in the accumulators, and of the cylinder capacity chosen for the motor 10, various different torques can be delivered by the motor 10 of the hydraulic circuit 200. In particular, the cylinder capacity of the motor 10 can be adapted to the variable pressure of the accumulators in order to maintain substantially constant torque in a manner such as, for example, to maintain substantially constant acceleration on the vehicle.

With reference to FIGS. 7A and 7B, a hydraulic circuit 500 of the invention, in an embodiment that is different from the hydraulic circuit 200 of FIGS. 6A to 6C, is described below in two operating modes.

The hydraulic circuit 500 includes: a hydraulic pump 502 having a variable flow rate; a hydraulic motor 504 with two elementary motors 506 and 508; two pressure accumulators 510 and 512 that are respectively high-pressure and low-pressure accumulators. The main orifices of the pump 502 are connected via a main duct 514 to the feed and discharge orifices of the elementary motor 506. The communication orifices of the accumulators 510 and 512 are connected via another main duct 516 to the elementary motor 508.

The motor 504 also has four distribution valves (not shown), interposed respectively on the fluid feed and discharge ducts of the two elementary motors 506 and 508.

The motor 504 has an outlet shaft 518, to which the two elementary motors 506 and 508 deliver torque; said shaft 518 is coupled to a wheel 520.

Operation of this hydraulic circuit, and in particular the respective roles played by the two elementary motors 506 and 508 that are fed with fluid by different pressurized fluid sources is shown by FIGS. 7A and 7B.

FIG. 7A shows forward operation of the motor in an operating mode with use being made of the energy stored in the pressure accumulators.

Under the effect of the pressure of the fluid delivered by the pressure accumulator 510 and that flows through the elementary motor 508 before reaching the other pressure accumulator 512, said elementary motor 508 transmits first torque to the shaft 518. In conventional manner, and under the effect of the fluid flow rate injected by the pump 502, the elementary motor 506 applies second torque to the shaft 518. Depending on the pressures established in the circuit 514 at the feed and discharge orifices of the elementary motor 506, this second torque can be added to or subtracted from the first torque of the elementary motor 508 so as to obtain the desired torque on the wheel 520.

FIG. 7B shows an opposite situation, in which energy is stored. The elementary motor 508 sends the pressurized fluid back into the high-pressure accumulator 510. The torque necessary for driving the elementary motor in this situation can be delivered by the wheel when the vehicle is in a braking stage. As explained above, the torque generated by the elementary motor 506 can be added to or subtracted from the torque of the wheel in such a manner as to compensate for the difference between the desired torque for braking the wheel and the torque necessary for driving the elementary motor 508 that fills the accumulator.

It is also possible to store energy while the vehicle is in an acceleration phase, the energy that is tapped not therefore being convertible into energy for driving the vehicle. In such a situation, the elementary motor 506 must deliver, at the same time, both the torque to the wheel 520 in order to enable the vehicle to accelerate, and also the torque necessary for the motor 508 to fill the accumulator. This configuration can be useful for storing energy when the vehicle's acceleration needs are low or indeed zero (traveling at constant speed), and for using this energy under circumstances under which high wheel-torque needs require action from both of the motors 506 and 508.

Use of one or the other of the operating modes described in detail above is chosen as a function, in particular, of the respective extents of fullness of the accumulators 510 and 512. When the high-pressure accumulator 510 starts to become empty, it is necessary to make provision for a filling stage to take place, even though that penalizes the power available on the outlet shaft 518 of the motor.

Other operating modes, in which one or the other of the elementary motors is rendered inactive, are not described in detail.

To summarize, in such a circuit 500, the elementary motor 506 can be operated by the control system (not shown) as follows: to deliver additional drive torque, i.e. top-up drive torque; or to deliver additional braking torque; or else it can remain inactive. The presence of said elementary motor 506, associated with the pressure accumulators 510 and 512, makes it possible, for example, to have torque that, during a drive stage or during a braking stage, is higher than the torque that it would be possible to have by using solely and directly the fluid pressure delivered by the pump. The multiple cylinder capacities that the motor 500 has thus make it possible to adapt the flow rate of fluid that is consumed by the motor, and to adapt the torque that is delivered, as a function of the available pressure in the pressure accumulator. In such a hydraulic circuit 500, the multiple cylinder capacities that are made possible by the motor 504 of the invention are then particularly valuable because they make it possible to compensate for the relative lack of flexibility, during use, of the pressure accumulators 510 and 512.

Finally, by means of the flexibility of the reversal of the direction of flow of fluid to the orifices of the elementary motor 508, said reversal can be caused at any time by the distribution valves of the motor, without it being necessary to reverse the direction of the flow of fluid in the circuit. The use of a reversible pump is not necessary.

In addition, a pump having a fixed flow rate may even be used, because of the operating flexibility of the motor that is imparted by its multiple cylinder capacities. The variations in speed and in torque are achieved, in particular, by changing cylinder capacity.

With reference to FIGS. 8A to 8E, five operating modes of a hydraulic circuit of the invention, in an embodiment different from the preceding embodiments, are described below.

The hydraulic circuit 600 shown in FIGS. 8A to 8E makes it possible to feed four hydraulic motors 602, 604, 606, and 608, disposed in respective ones of the four wheels of a vehicle, and making it possible to drive said vehicle.

By convention, in these figures, the front of the vehicle is pointing towards the top of the sheet.

The circuit 600 includes a central pump 610 and two distinct main ducts 612 and 614, connected to respective ones of the two main orifices of the pump. The main duct 612 is connected to a first orifice (feed orifice or discharge orifice) of each of the four motors 602, 604, 606, and 608; the main duct 614 is connected to a second orifice of each of the four motors.

Finally, the hydraulic circuit is equipped with a central control system 620. Said control system transmits setpoints to the respective control systems of the motors 602, 604, 606, and 608 via cables 625. On the basis of these setpoints, the control systems establish the control for the distribution valves of the various motors 602, 604, 606, and 608.

Each of the four motors 602, 604, 606, and 608 is a motor of the invention. Each of said motors can transmit output torque to the wheel to which it is coupled, which torque is said to be "normal" if it is the maximum torque that can be delivered by the motor, or "reduced" if it is a fraction of that torque, which fraction is strictly less than 1.

In addition, the torque applied to a wheel can be drive torque if it is torque applied in the direction that tends to cause the vehicle to advance in the forward direction when all of the wheels apply torque in that same direction; it can be opposing torque if the torque is applied in the opposite direction. In particular, it should be noted that the output torque applied to the respective wheels by each of said motors may be reversed merely by a command from the control system of the motor, without it being necessary to reverse the direction of flow of the fluid feeding the motors.

By means of the hydraulic circuit 600, the following five drive modes are possible for driving the vehicle, corresponding to FIGS. 8A to 8E:

- normal forward drive (FIG. 8A); each of the four motors delivers normal drive torque;
- fast forward drive (FIG. 8B); each of the two rear motors 606 and 608 delivers normal drive torque; each of the two front motors 602 and 604 delivers reduced drive torque; the total cylinder capacity of the circuit is thus smaller than in the preceding situation, thereby enabling the vehicle to reach a higher speed;
- very fast forward drive (FIG. 8C); each of the two front motors 602 and 604 delivers normal drive torque; the two rear motors 606 and 608 deliver reduced opposing torque; the total cylinder capacity of the circuit is thus very small, thereby enabling the vehicle to reach a very high speed;
- right turn (FIG. 8D); each of the two left motors 602 and 606 delivers normal drive torque; each of the two right motors delivers reduced drive torque; the difference in torque causes the vehicle to turn rightwards; and
- rightward on-spot turn (FIG. 8E); each of the two left motors 602 and 606 delivers normal drive torque; each of the two right motors 604 and 608 delivers normal opposing torque, thereby causing the vehicle to turn on the spot.

Naturally, numerous other operating modes that are not shown are possible for the vehicle.

In addition, the use of this type of motor makes it possible, in the event that one of the wheels spins, to reduce the cylinder capacity of the motor, and therefore to reduce its output torque, thereby limiting spinning of the wheel, it being possible for the cylinder capacity to be reduced to the extent that the drive torque is reduced to zero by deactivating all of the elementary motors of said motor.

The invention claimed is:

1. A hydraulic motor having radial pistons, and including:

- a cylinder block, in which each cylinder has a chamber in which a piston is mounted to slide;
- a cam, on which each of the pistons can exert pressure in order to generate torque, the cam having at least two lobes, each lobe having a rising ramp and a falling ramp, the cylinder block being mounted to rotate relative to the cam;
- at least two main ducts, via which the hydraulic motor can receive or send fluid,
- a fluid distributor for distributing the fluid from said main ducts to the cylinders, which distributor includes, for each cylinder, a distribution valve configured to connect the chamber of the cylinder to one or the other of said main ducts, so as to enable fluid to enter into or to exit from said chamber; and
- a control system including an angular position sensor for sensing the angular position of the cam relative to the cylinder block, for controlling the distribution valves wherein:
- a) the hydraulic motor includes at least two elementary motors, wherein, with the lobes being distributed in one or more groups of lobes and the cylinders being distributed in one or more groups of cylinders, each elementary motor is defined by a group of cylinders and by a group of lobes, and includes those of the cylinders of the group of cylinders that act on the lobes of the group of lobes, the elementary motor being, due to the arrangement of the group of cylinders and the group of lobes that define it, capable of delivering torque regardless of the angular position of the cam relative to the cylinder block;

b) the control system operates the distribution valves such that the hydraulic motor has a plurality of operation modes, in which operation modes, in each elementary motor, each of the cylinders is put into communication on the rising ramps with a first main duct and on the falling ramps with a second main duct, any changes to these communications taking place when the cylinder passes substantially facing a top or bottom dead center, on the basis of the information delivered by the angular position sensor; and c) a first elementary motor of the at least two elementary motors is driving when the hydraulic motor is in a first one of said operating modes, and is inactive or opposing when said hydraulic motor is in a second one of said operating modes, the control system operating the remainder of the hydraulic motor in the same way in said first and second operating modes.

2. A hydraulic motor according to claim 1, wherein, when the hydraulic motor is in said operating modes, a single group of lobes is defined, in such manner that each elementary motor includes all of the lobes of the cam.

3. A hydraulic motor according to claim 1, wherein, when the hydraulic motor is in said operating modes, a single group of cylinders is defined, in such manner that each elementary motor includes all of the cylinders.

4. A hydraulic motor according to claim 1, wherein the first elementary motor has a cylinder capacity that is different from the cylinder capacity of another elementary motor.

5. A hydraulic motor according to claim 1, wherein the control system includes an activation table that indicates and makes it possible to determine the operating modes of the various elementary motors as a function of a desired cylinder capacity, each operating mode being chosen from among drive, opposing, and inactive.

6. A hydraulic motor according to claim 1, wherein the control system automatically effects a plurality of cylinder capacity changes in a predefined order, as a function at least of a speed of rotation of the hydraulic motor and of a speed or acceleration setpoint transmitted to the hydraulic motor.

7. A hydraulic motor according to claim 1, wherein, when the hydraulic motor is in one of said states, the control system operates the distribution valves, in such a manner that two elementary motors exert torque in opposite directions.

8. A hydraulic motor according to claim 1, wherein the elementary motors are constant-velocity motors.

9. A hydraulic motor according to claim 1, wherein the fluid distributor has, for at least one elementary motor, inactivation means connecting said elementary motor in a continuous manner to the main duct having a pressure chosen from among the lower pressure and the higher pressure of the main ducts.

10. A hydraulic motor according to claim 9, wherein the inactivation means include means for detecting the direction of rotation of the hydraulic motor, said chosen pressure being selected as a function of the direction of rotation of the hydraulic motor and of the direction of a speed command or of an acceleration command that is applied to the hydraulic motor.

11. A hydraulic motor according to claim 1, wherein, at least for one elementary motor, the pistons are retractable, such that they are disengaged from the cam.

12. A hydraulic motor according to claim 1, wherein, when the hydraulic motor is in said states, the control system is suitable for operating the distribution valves in such a manner as to revert the direction of rotation of an outlet member of the hydraulic motor without reversing the input and output directions in which the fluid is input and output in the hydraulic motor.

13. A hydraulic motor according to claim 1, wherein, when the hydraulic motor is in said operating modes, the control system operates the distribution valves in such a manner as to maintain the direction of rotation of an outlet member of the motor constant, during a reversal of input and output directions in which the fluid is input and output through the hydraulic motor.

14. A hydraulic motor according claim 1, wherein the fluid distributor is disposed substantially along the axis of rotation over the cylinder block.

15. A hydraulic circuit comprising:

at least one first hydraulic motor according to claim 1, coupled to a first movement member for moving a vehicle; and at least one second hydraulic motor, coupled to a second movement member for moving a vehicle;

the control system of the first motor being capable of causing the first motor and thus the first movement member to rotate at a different speed or in an opposite direction relative to the speed and direction of the second movement member.

16. A hydraulic circuit comprising at least one hydraulic motor according to claim 1, and at least two pressure accumulators, connected to two main ducts of the hydraulic motor;

the hydraulic motor comprising:

two first main ducts connected to the two pressure accumulators;

two second main ducts connected to the main orifices of a pressurized fluid source other than said pressure accumulators;

a first group of at least one elementary motor, the distribution valves of which are suitable for connecting the cylinders of said at least one elementary motor of the group to said first main ducts;

a second group of at least one elementary motor, the distribution valves of which are suitable for connecting the cylinders of the at least one elementary motor of the group to said second main ducts.

17. A method of controlling a hydraulic motor having radial pistons, said hydraulic motor comprising:

a cylinder block, in which each cylinder has a chamber in which a piston is mounted to slide;

a cam, on which each of the pistons can exert pressure in order to generate torque, the cam having at least two lobes, each lobe having a rising ramp and a falling ramp, the cylinder block being mounted to rotate relative to the cam;

at least two main ducts, via which the hydraulic motor can receive or send fluid;

a fluid distributor for distributing the fluid from said main ducts to the cylinders, which distributor includes, for each cylinder, a distribution valve suitable configured to connect the chamber of the cylinder to one or the other of said main ducts, so as to enable fluid to enter into or to exit from said chamber; and a control system including an angular position sensor for sensing the angular position of the cam relative to the cylinder block, for controlling the distribution valves;

the hydraulic motor including at least two elementary motors;

the method comprising:

the hydraulic motor is operated in at least a first and a second operating state by means of the distribution valves;

in each of said states, in each elementary motor, each of the cylinders is put into communication on the rising ramps with a first main duct and on the falling ramps with a second main duct, any changes to these communications taking place when the cylinder passes substantially facing a top or bottom dead center, on the basis of the information delivered by the angular position sensor;

in the first state, a first elementary motor is driving; and in the second state, the first elementary motor is inactive or opposing the control system operating the remainder of the hydraulic motor in the same way in said first and operation modes.

18. A hydraulic motor according to claim 9, wherein the inactivation means includes pressure sensors detecting which of the at least two main ducts is at a lower pressure.

* * * * *